US005810369A

United States Patent [19]

Wilder et al.

[11] Patent Number: 5,810,369

[45] Date of Patent: Sep. 22, 1998

[54] SKATE CHASSIS HAVING A-FRAME CONSTRUCTION

[75] Inventors: Thomas Vaughn Wilder, Laguna Niguel; Alexander Parker Reynolds, Newport Beach, both of Calif.

[73] Assignee: Dare Development, Inc., Santa Ana, Calif.

[21] Appl. No.: 682,808

[22] Filed: Jul. 10, 1996

[51] Int. Cl.[6] ..... A63C 17/06

[52] U.S. Cl. ..... 280/11.22; 280/11.27

[58] Field of Search ..... 280/11.19, 11.2, 280/11.22, 11.23, 11.27, 11.25, 11.28

[56] References Cited

U.S. PATENT DOCUMENTS

| | | | |
|---|---|---|---|
| D. 354,105 | 1/1995 | Meibock et al. . | |
| D. 354,539 | 1/1995 | Meibock et al. . | |
| 4,273,345 | 6/1981 | Ben-Dor et al. | 280/11.2 |
| 4,492,385 | 1/1985 | Olson . | |
| 5,048,848 | 9/1991 | Olson et al. . | |
| 5,308,152 | 5/1994 | Ho | 301/5.3 |
| 5,374,070 | 12/1994 | Pelligrini et al. | 280/11.2 |
| 5,388,846 | 2/1995 | Gierveld | 280/11.27 X |
| 5,513,861 | 5/1996 | Monroy et al. | 301/5.34 X |
| 5,533,740 | 7/1996 | Lin | 280/11.27 X |
| 5,586,777 | 12/1996 | Wolf | 280/11.22 |

FOREIGN PATENT DOCUMENTS

| | | |
|---|---|---|
| 8104249 | 4/1982 | Netherlands . |

*Primary Examiner*—Brian L. Johnson
*Assistant Examiner*—Michael Mar
*Attorney, Agent, or Firm*—Knobbe, Martens, Olson & Bear, LLP

[57] ABSTRACT

An A-frame chassis for an in-line roller skate is provided having more efficient power transfer and enhanced structural integrity for a given weight. Longitudinally extending members are provided having angled upper portions and substantially parallel lower portions. The chassis preferably has a unibody aluminum construction. The axle holes are preferably flush-mounted and rockerable.

12 Claims, 4 Drawing Sheets

SKATE CHASSIS HAVING A-FRAME CONSTRUCTION

BACKGROUND OF THE INVENTION

1. Field of the Invention

The present invention relates generally to the field of roller hockey skates, and, in particular, to a chassis for attachment to a skating boot for receiving a set of in-line wheels.

2. Description of the Related Art

Chassis for in-line roller skates typically have front and rear (or toe and heel) attachment members for attachment to a skating boot. The boot is typically attached to the attachment members by rivets extending through the sole of the boot. Extending below these attachment members are flat, parallel members generally forming an H-shaped frame of the chassis for receiving a wheelset comprising four or more in-line skate wheels. The wheels are mounted between the parallel members and are supported by axles extending through holes in the parallel members.

SUMMARY OF THE INVENTION

In accordance with one embodiment, an in-line roller skating chassis having features in accordance with the present invention provides enhanced structural integrity and more efficient power transfer. The chassis generally comprises a pair of longitudinal members having upper and lower portions. The upper portions form planes or curved surfaces which converge in an upward direction and inwardly at an angle of about 80 degrees from the horizontal. The lower portions are substantially parallel and have axle holes sized and shaped to receive the wheels.

A substantially horizontal web having one or more sections preferably extends between the longitudinal members, below the forefoot and heel attachment members, to connect the lower portions of the longitudinal members. Preferably, the web is formed at the junction of the upper and lower portions, such that below the web the longitudinal members are substantially parallel. The web also preferably has a plurality of openings having chamfered edges to accommodate close positioning of the wheels with the web and to achieve a shorter overall length of the skate from front to rear wheel as is desirable for increased maneuverability. This configuration is referred to herein as an "A-frame" chassis.

Further advantages and applications will become apparent to those skilled in the art from the following detailed description of the preferred embodiment and the drawings referenced herein, the invention not being limited to any particular embodiment described herein.

DETAILED DESCRIPTION OF THE PREFERRED EMBODIMENT

Figure 1:
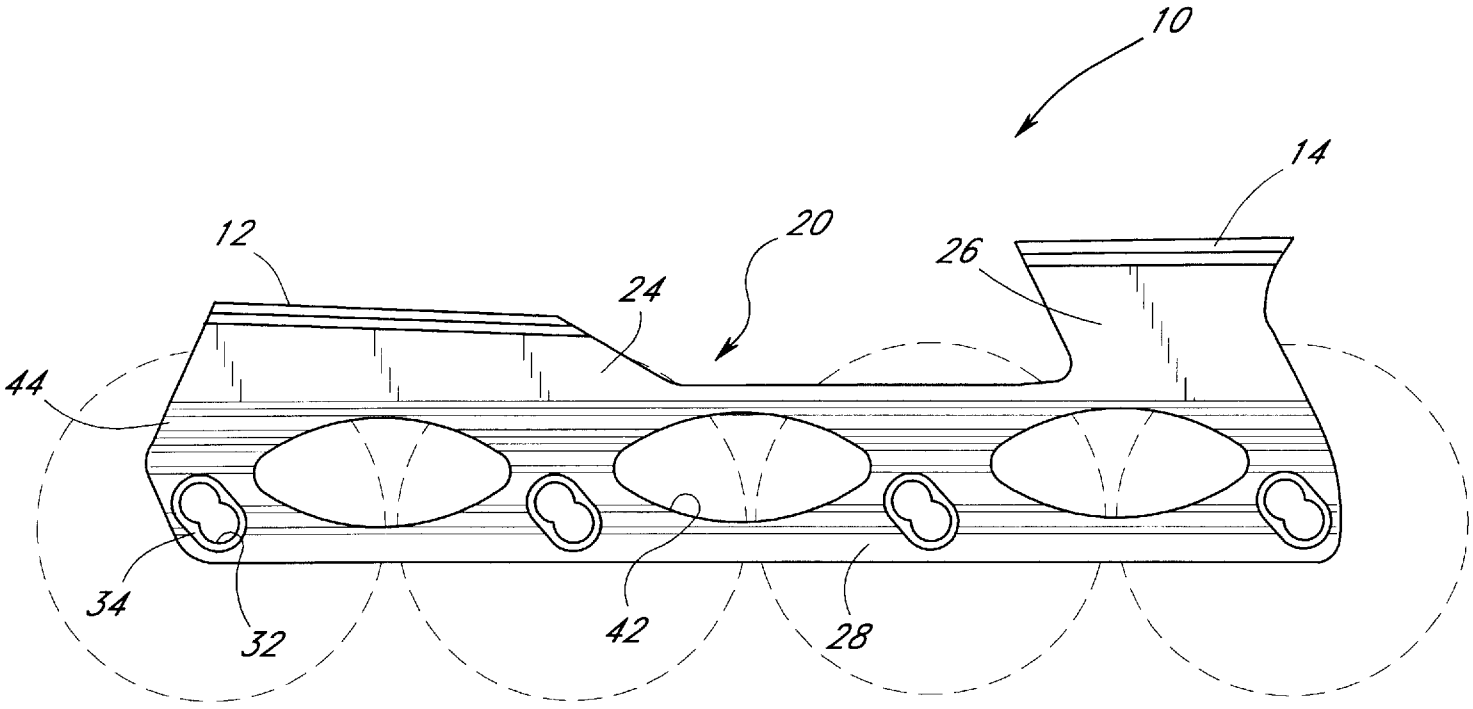
FIG. 1 is a side elevational view of a preferred embodiment of a skate chassis having features of the present invention.

FIG. 1 shows an in-line roller skate chassis 10 having features in accordance with the present invention. The chassis 10 may be attached to the rigid sole of a skating boot (not shown) using rivets through holes 16, 18 of attachment members 12, 14 (see FIGS. 4 and 5). The forefoot attachment member 12 is slightly lower in height than the heel attachment member 14 to accommodate a forward skating stride. The forefoot attachment member 12 is also preferably larger and thicker than the heel attachment member 14, since during skating the forefoot attachment member 12 bears much of the weight and transfers much of the power from the skater to the skate. The attachment members 12, 14 also preferably have a contoured upper surface conforming to the curved shape of a foot or boot sole.

Figure 2:
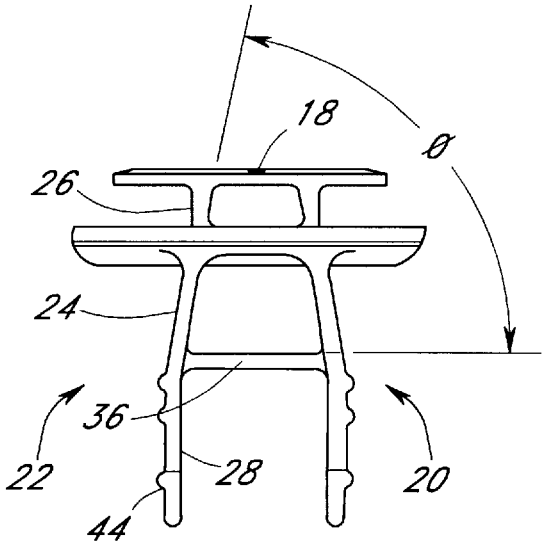
FIG. 2 is a front elevational view of the chassis of FIG. 1.
Figure 3:
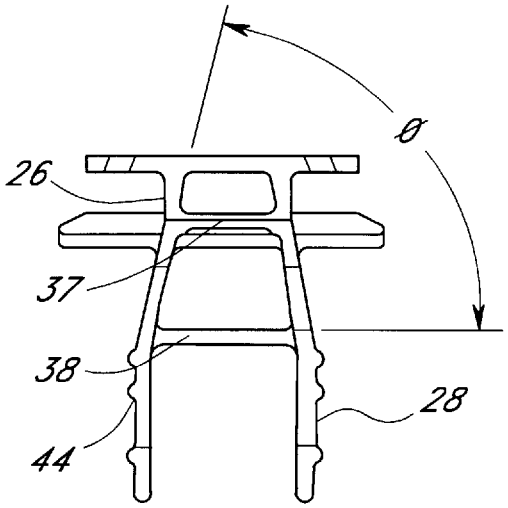
FIG. 3 is a rear elevational view of the chassis of FIG. 1.

A pair of longitudinal members 20, 22 extend downwardly below the forefoot and heel attachment members 12, 14, along the longitudinal axis of the chassis 10. The longitudinal members 20, 22 have upper portions 24, 26 attached to the lower surfaces of the attachment members 12, 14, and lower portions 28 for accommodating attachment of a wheelset 30 (shown in phantom). These longitudinal members 20, 22 generally form an "A"-shape or frame of the chassis 10 when viewed from the front or rear, as shown in FIGS. 2 and 3, respectively. A preferred incline angle $\phi$ from horizontal formed by the upper portions 24, 26 is about 80 degrees; although, in alternative embodiments the angle $\phi$ may vary from about 88 to 60 degrees while providing the benefits and advantages of the present invention. Alternatively, one of the upper portions 24, 26 may be inclined, while the other is co-planar with its corresponding lower portion 28, thereby resulting in a modified A-frame arrangement also having benefits in accordance with the present invention.

The chassis 10 of the present invention, and, in particular, the angling of the upper portions 24, 26 of the members 20, 22, provides enhanced structural integrity for a given weight and more efficient power transfer. This A-frame design also helps to accommodate lateral forces imparted to the skate by the skater. This is particularly advantageous for the quick movements which occur during roller hockey, as well as when a skater leans into the instep side of the skate to push off during skating strides.

Referring once more to FIG. 1, the lower portions 28 of the members 20, 22 preferably have openings 42 and ribs 44 formed on them, as desired, for weight reduction of the chassis and for aesthetics. Alternatively, more or less, or no, ribs 44 may be formed on the chassis 10. The openings 42 may also be omitted or have different shapes, such as round or polygonal, as desired.

Typically, four in-line wheels are used for roller hockey skates; although, the present invention may alternatively be used with a wheelset 30 having six wheels or more, such as for speed skating. As indicated in phantom in FIG. 1, the wheels 30 are mounted in pairs of holes 32 formed in the lower portions 28 of the members 20, 22 of the chassis 10. Referring to FIG. 1, the holes 32 are preferably "rockerable", or figure-8 shaped, and tilted upward toward the front of the chassis 10, as shown. Rockerable axle holes allow alternate positioning of wheels to be used with the chassis, with larger wheel diameters typically using the lower position of the figure-8, as shown. Also, the holes 32 preferably have recesses 34 formed at the exterior surfaces of the longitudinal members 20, 22 to allow the ends of the wheel axles (not shown) to be substantially flush-mounted with the exterior surfaces of the longitudinal members 20, 22. Alternatively, the holes 32 may be other shapes, such as circular with or without recesses 34 for flush-mounting of the wheel axles.

Figure 4:
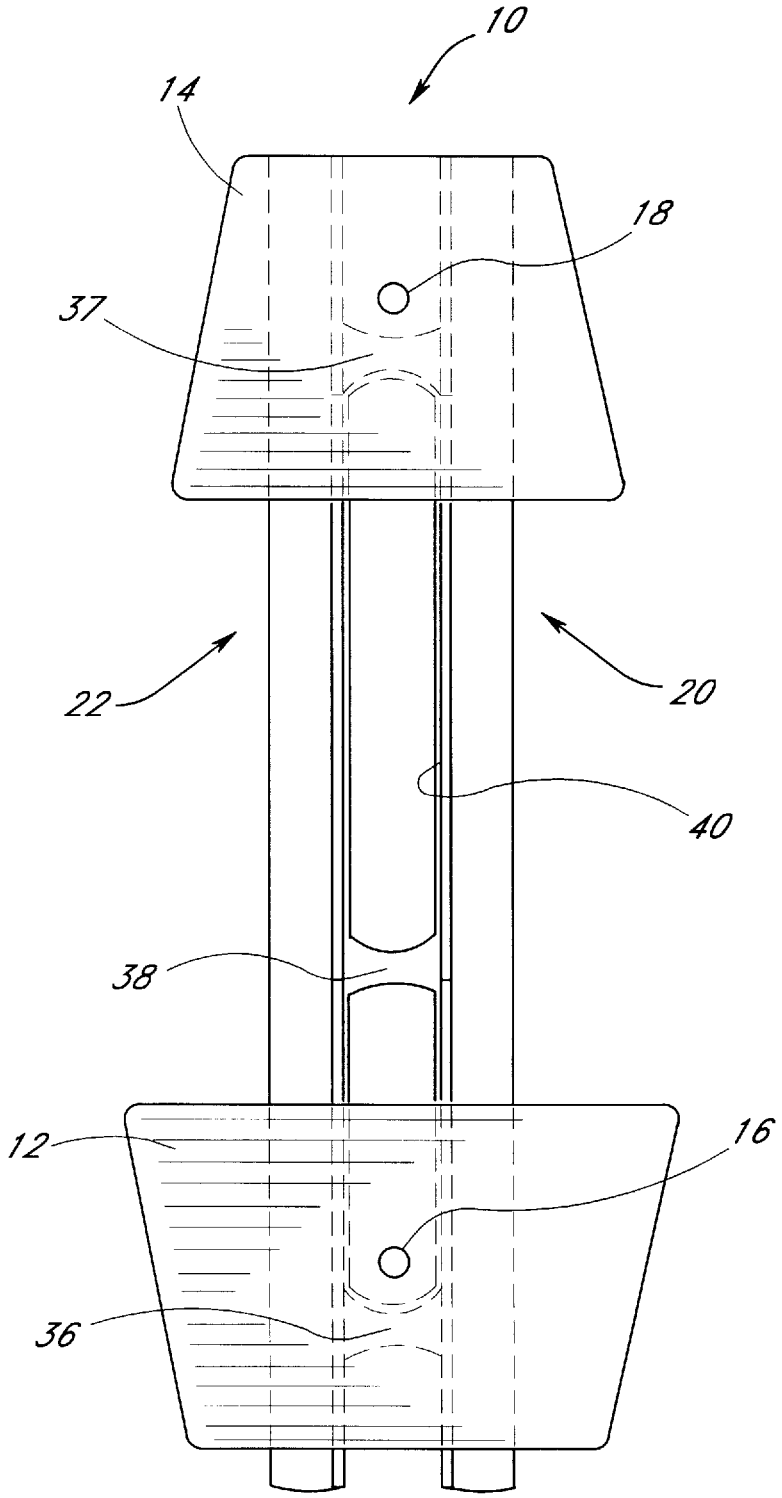
FIG. 4 is a top plan view of the chassis of FIG. 1.
Figure 5:
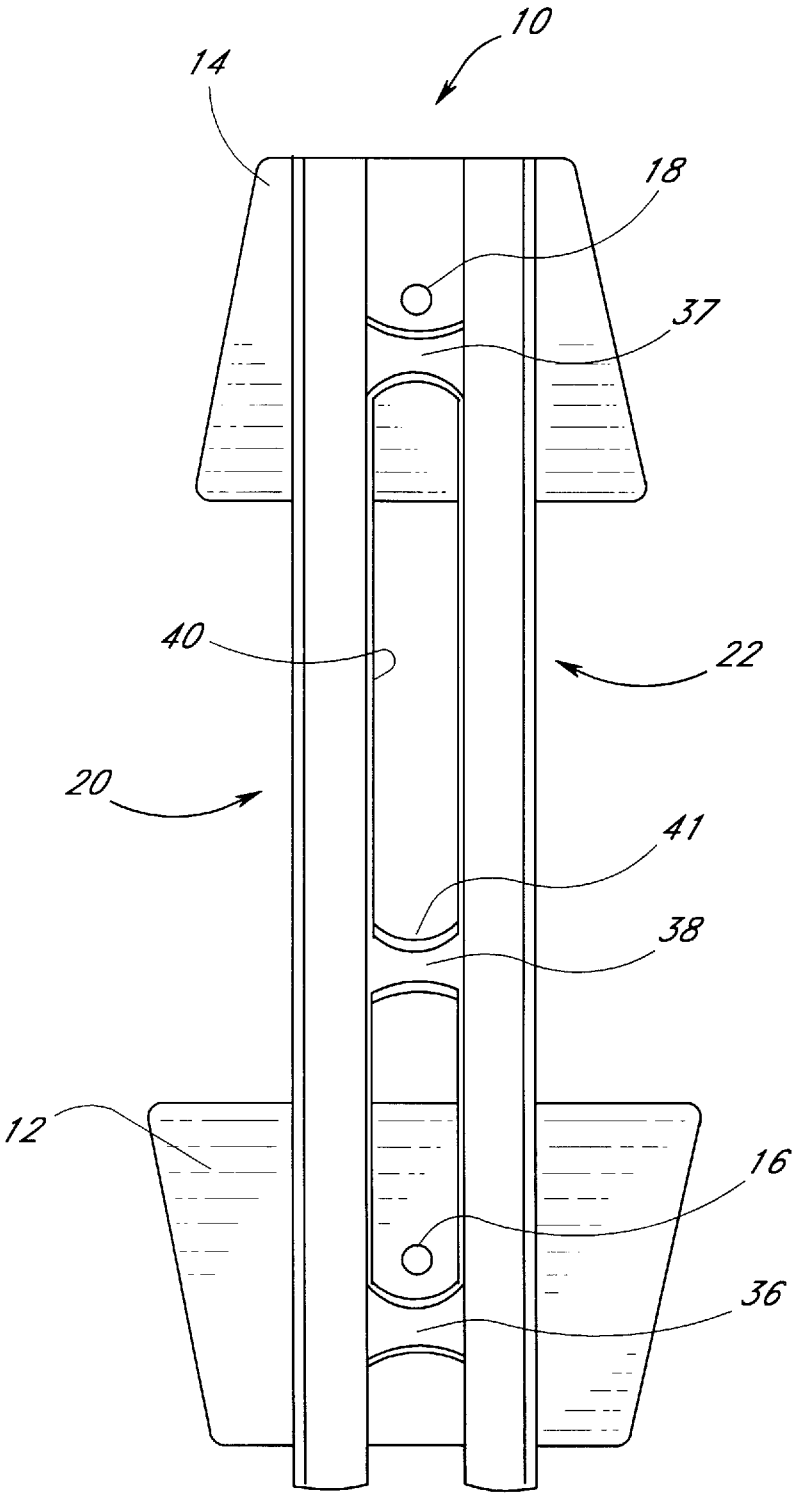
FIG. 5 is a bottom plan view of the chassis of FIG. 1.

Referring to FIGS. 4 and 5, a web having lateral sections 36, 37 extend approximately below the forefoot attachment member 12 and below the heel attachment member 14, respectively, to connect and strengthen the longitudinal members 20, 22. Preferably, another lateral section 38 connects the longitudinal members 20, 22 near the middle of the chassis 10 along its length. A plurality of openings 40 are provided to accommodate the wheels 30. The portions of the openings 40 defined by each web section 36–38 preferably have chamfered or contoured edges 41 (FIG. 5). This accommodates closer positioning of adjacent wheels 30 through the openings 40 of the web sections 36–38. Skates having a shorter length from the front to rear wheel 30 are often desirable for maneuverability.

The chassis 10 preferably has a unibody construction, substantially formed from an extruded aluminum billet which is then machined in a method known to those skilled in the art. The preferred material is 7116 aluminum alloy with T6 heat treatment; although, other alloys and treatments may be used with the present invention with equally beneficial results. In alternative embodiments, the attachment members 12, 14, longitudinal members, 20, 22, and web sections 36–38 may be separately formed and welded together, as desired, or other suitable manufacturing techniques may be used.

The embodiment described herein is provided merely for illustration. Changes and modifications may be made from the embodiment presented herein by those skilled in the art without departure from the spirit and scope of the invention, as defined by the appended claims.

What is claimed is:

1. An integrally formed roller skate chassis adapted for attachment of a plurality of skate wheels, said chassis comprising:

a heel attachment member and a forefoot attachment member for attaching said chassis to a skating boot; and a pair of laterally spaced longitudinal members, said longitudinal members having generally planar upper portions with upper edges integrally attached to said heel and forefoot attachment members and lower portions for accommodating attachment of a wheel set, one of said upper portions being substantially coplanar with a respective lower portion, the other one of said upper portions being inclined toward the coplanar one of said upper portions, said lower portions in an upwardly extending direction being substantially parallel to each other, and one or more connecting webs extending between said longitudinal members and integrally attached to said longitudinal members where said upper and lower portions intersect;

wherein said chassis has enhanced structural integrity for a given weight of material.

2. The chassis of claim 1, wherein said lower portions have one or more horizontally elongated openings formed therein to reduce weight and excess material.

3. The chassis of claim 1, wherein said lower portions have one or more ribs formed thereon.

4. The chassis of claim 1, wherein said connecting webs have one or more chamfered edges adjacent to said skate wheels so as to accommodate closer spacing between said skate wheels.

5. An integrally formed roller stake chassis, adapted for attachment of a plurality of skate wheels, said chassis comprising:

a heel attachment member and a forefoot attachment member for attaching said chassis to a skating boot; and a pair of laterally spaced longitudinal members having upper edges integrally attached to said heel and forefoot members, said longitudinal members having upper and lower generally planar portions separated by one or more web members extending between said longitudinal members and attached thereto, said upper portions forming substantially convergent planes in an upwardly extending direction above said one or more web member, said lower portions forming substantially parallel planes below said one or more web members, such that said chassis forms substantially an A-frame when viewed in cross section;

wherein said chassis has enhanced structural integrity and more efficient transfer of power from a skater to said skate wheels during use.

6. The chassis of claim 5, wherein said one or more web members are spaced to form a plurality of openings for accommodating said wheels.

7. The chassis of claim 5, wherein said chassis has an extruded unibody construction.

8. The chassis of claim 7, wherein said chassis is formed from an extruded aluminum billet which is machined to the desired shape.

9. The chassis of claim 5, wherein said chassis has flush-mounted, rockerable axle holes.

10. The chassis of claim 5, wherein said lower portions have at least one horizontally elongated opening formed therein to reduce weight and excess material.

11. The chassis of claim 5, wherein said lower portions have at least one rib formed thereon.

12. The chassis of claim 5, wherein said web members have at least one chamfered edge adjacent to said skate wheels so as to accommodate closer spacing between said skate wheels.

* * * * *